US011511957B2

(12) United States Patent
Hirai et al.

(10) Patent No.: US 11,511,957 B2
(45) Date of Patent: Nov. 29, 2022

(54) MEDIUM CONVEYANCE DEVICE

(71) Applicant: PFU Limited, Ishikawa (JP)

(72) Inventors: Yoshito Hirai, Ishikawa (JP); Naoto Yamaguchi, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 184 days.

(21) Appl. No.: 16/853,522

(22) Filed: Apr. 20, 2020

(65) Prior Publication Data

US 2020/0239250 A1 Jul. 30, 2020

Related U.S. Application Data

(63) Continuation of application No. PCT/JP2017/041344, filed on Nov. 16, 2017.

(51) Int. Cl.
*B65H 3/46* (2006.01)
*B65H 3/08* (2006.01)
*B65H 7/12* (2006.01)

(52) U.S. Cl.
CPC ..... *B65H 3/46* (2013.01); *B65H 3/08* (2013.01); *B65H 7/12* (2013.01)

(58) Field of Classification Search
CPC ... B65H 3/46; B65H 3/08; B65H 7/12; B65H 2511/521
See application file for complete search history.

(56) References Cited

U.S. PATENT DOCUMENTS

| | | | | |
|---|---|---|---|---|
| 7,690,650 | B2 * | 4/2010 | Itoh | B65H 5/062 271/263 |
| 8,651,473 | B2 * | 2/2014 | Suzuki | B65H 7/20 270/58.33 |
| 2008/0111294 | A1 * | 5/2008 | Itoh | B65H 5/062 700/219 |
| 2011/0221117 | A1 | 9/2011 | Taki et al. | |

FOREIGN PATENT DOCUMENTS

| | | | | |
|---|---|---|---|---|
| JP | 2007-230687 | A | 9/2007 | |
| JP | 2007-302376 | A | 11/2007 | |
| JP | 2008-120493 | A | 5/2008 | |
| JP | 4118135 | B2 * | 7/2008 | |
| JP | 2011-184201 | A | 9/2011 | |
| JP | 2011-256049 | A | 12/2011 | |
| JP | 2012-188279 | A | 10/2012 | |
| WO | WO-2018138890 | A1 * | 8/2018 | B65H 37/00 |

OTHER PUBLICATIONS

International Search Report issued in corresponding International Patent Application No. PCT/JP2017/041344, dated Feb. 6, 2018, with English translation.

* cited by examiner

*Primary Examiner* — Howard J Sanders
(74) *Attorney, Agent, or Firm* — McDermott Will & Emery LLP

(57) ABSTRACT

A medium conveyance device includes a first separator that separates a first medium from a plurality of mediums, a processor that processes the first medium and sends the processed first medium as a second medium, a second (Continued)

separator that when a non-separation mode is set, conveys the second medium to a next processor, and when a separation mode is set, conveys a third medium, which is separated from the second medium, to the next processor, and a controller that switches between the non-separation mode and the separation mode based on information obtained as a result of processing the first medium.

8 Claims, 6 Drawing Sheets

MEDIUM CONVEYANCE DEVICE

CROSS-REFERENCE TO RELATED APPLICATION

This application is a continuation of International Application No. PCT/JP2017/041344, filed on Nov. 16, 2017, the entire contents of which are incorporated herein by reference.

FIELD

The embodiments discussed herein are related to a medium conveyance device.

BACKGROUND

It is a popular practice to use a scanner device and digitize a plurality of mediums bound using binders. Among document automatic feeders, there are known devices that include a separator for separating the mediums and a sensor for detecting the states of the mediums; and in which, based on the detection result of the sensor, the separator switches between separating and not separating the mediums (refer to Japanese Laid-open Patent Publication No. 2011-184201, Japanese Laid-open Patent Publication No. 2012-188279 and Japanese Laid-open Patent Publication No. 2007-302376).

Among the mediums bound using binders, sometimes there are bound mediums formed by binding a plurality of singular mediums using a stapler or a clip. When such a bound medium is directly separated into a plurality of singular mediums, sometimes it may result in damaging the bound medium or causing a failure in the scanner device.

SUMMARY

According to an aspect of an embodiment, a medium conveyance device includes a first separator that separates a first medium from a plurality of mediums, a processor that processes the first medium and sends the processed first medium as a second medium, a second separator that when a non-separation mode is set, conveys the second medium to a next processor, and when a separation mode is set, conveys a third medium, which is separated from the second medium, to the next processor, and a controller that switches between the non-separation mode and the separation mode based on information obtained as a result of processing the first medium.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Figure 1:
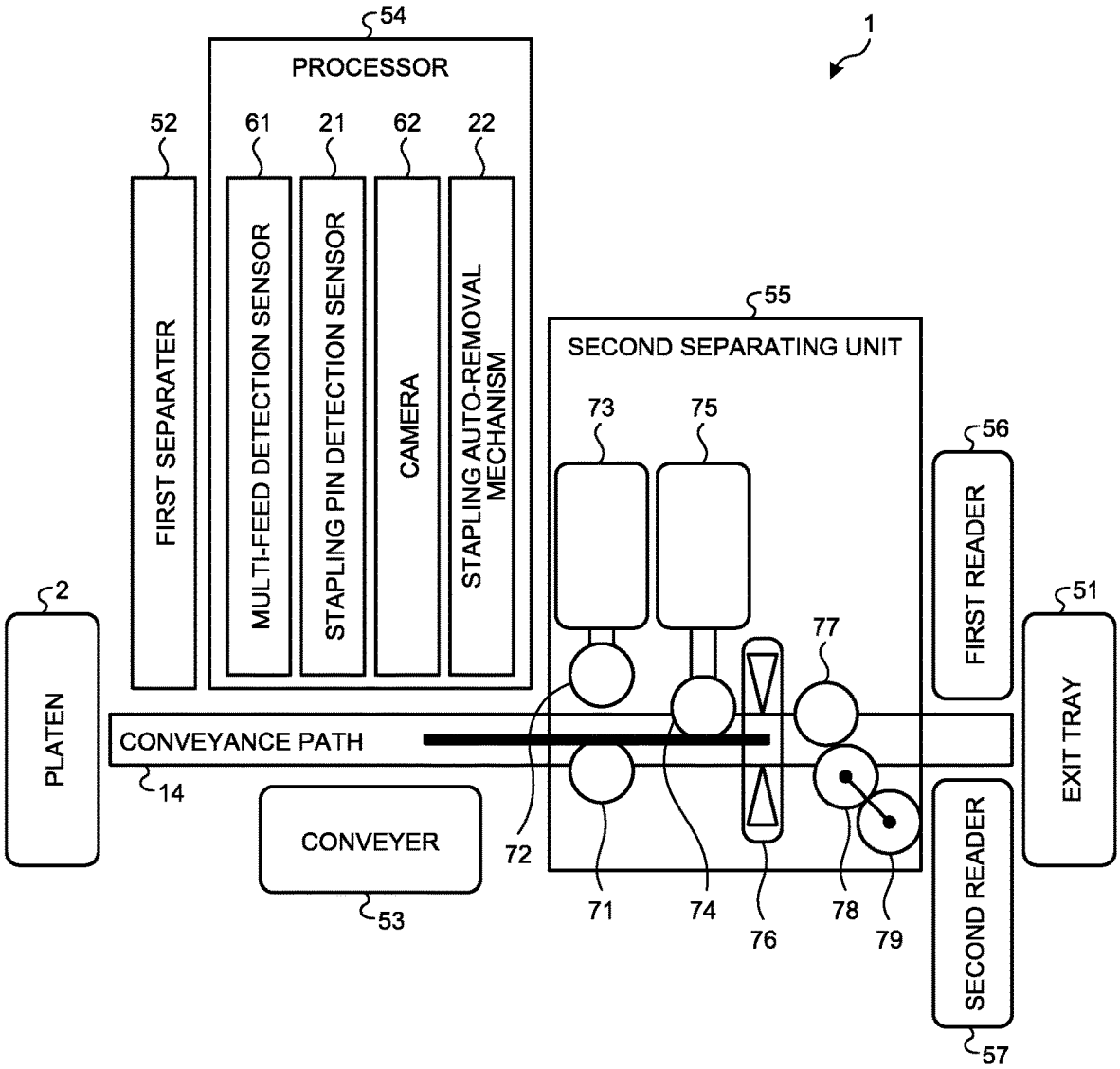
FIG. 1 is an outline side view of a medium conveyance device according to a first embodiment.

Preferred embodiments of the disclosure will be explained with reference to accompanying drawings. Exemplary embodiments of a medium conveyance device disclosed in the application concerned are described below with reference to the accompanying drawings. However, the present disclosure is not limited by the description given below. Moreover, in the description given below, identical constituent elements are referred to by the same reference numerals, and their explanation is not repeated.

First Embodiment

FIG. 1 is an outline side view of a medium conveyance device 1 according to a first embodiment. The medium conveyance device 1 is used as an image reading device and includes a platen 2, a conveyance path 14, and an exit tray 51 as illustrated in FIG. 1. The conveyance path 14 joins the platen 2 to the exit tray 51, and constitutes the path via which a medium is conveyed from the platen 2 to the exit tray 51.

The medium conveyance device 1 further includes a first separator 52, a conveyer 53, a processor 54, a second separator 55, a first image reader 56, and a second image reader 57. The first separator 52 is disposed at that end of the conveyance path 14 which is on the side of the platen 2. The first separator 52 makes use of the airflow and sends one of a plurality of mediums, which is placed on the platen 2, into the conveyance path 14. The conveyer 53 conveys the medium, which has been sent into the conveyance path 14 by the first separator 52, along the conveyance path 14 toward the exit tray 51, and places the medium on the exit tray 51.

The processor 54 includes a multi-feed detection sensor 61, a stapling pin detection sensor 21, a camera 62, and a stapling auto-removal mechanism 22. The multi-feed detection sensor 61 is disposed on the downstream side of the first separator 52, that is, is disposed in between the first separator 52 and the exit tray 51 in the conveyance path 14. The multi-feed detection sensor 61 detects whether the medium sent by the first separating into the conveyance path 14 is made of a plurality of singular mediums or made of only one singular medium. A singular medium implies a single sheet of paper. The stapling pin detection sensor 21 is disposed on the downstream side of the multi-feed detection sensor 61 in the conveyance path 14, that is, is disposed in between the multi-feed detection sensor 61 and the exit tray 51 in the conveyance path 14. The stapling pin detection sensor 21 detects whether or not the medium conveyed via the conveyance path 14 is stapled. The camera 62 and the stapling auto-removal mechanism 22 is disposed on the downstream side of the stapling pin detection sensor 21 in the conveyance path 14, that is, is disposed in between the stapling pin detection sensor 21 and the exit tray 51 in the conveyance path 14. When the medium that is conveyed via the conveyance path 14 is stapled, the camera 62 takes an image that captures the medium being conveyed via the conveyance path 14. Moreover, when the medium that is conveyed via the conveyance path 14 is stapled, the stapling auto-removal mechanism 22 removes the stapling from the stapled medium being conveyed via the conveyance path 14.

The second separator 55 includes a conveyance roller 71, a pinch roller 72, a first solenoid actuator 73, a pick roller 74, a second solenoid actuator 75, a medium detection sensor 76, a separating roller 77, a brake roller 78, and an electromagnetic clutch 79. The conveyance roller 71 is formed to have a cylindrical shape. Similarly, the pinch roller 72 is formed to have a cylindrical shape. The conveyance roller 71 and the pinch roller 72 are disposed on the downstream side of the processor 54 in the conveyance path 14, that is, are disposed in between the processor 54 and the exit tray 51 in the conveyance path 14. Moreover, the conveyance roller 71 is disposed in the lower portion of the conveyance path 14 and makes contact with the underside face of the medium that is conveyed via the conveyance path 14. The pinch roller 72 is disposed in the upper portion of the conveyance roller 71. The first solenoid actuator 73 makes the pinch roller 72 move in the vertical direction in such a way that the gap between the conveyance roller 71 and the pinch roller 72 gets adjusted; and places the pinch roller 72 either at an away position or at a load position.

When placed at the away position, the pinch roller 72 retracts from the conveyance path 14 as illustrated in FIG. 1. Thus, the pinch roller 72 moves away from the conveyance roller 71 and from the medium being conveyed in the conveyance path 14. When the pinch roller 72 is placed at the away position, it does not press the medium, which is being conveyed in the conveyance path 14, against the conveyance roller 71; and thus enables achieving reduction in the frictional force exerted between the conveyance roller 71 and the medium.

The pick roller 74 is formed to have a cylindrical shape. Moreover, the pick roller 74 is disposed on the downstream side of the conveyance roller 71 in the conveyance path 14, that is, is disposed in between the conveyance roller 71 and the exit tray 51 in the conveyance path 14. Furthermore, the pick roller 74 is disposed above the conveyance path 14. The second solenoid actuator 75 makes the pick roller 74 move in the vertical direction, and keeps it either at an away position or at a load position.

When placed at the load position, the pick roller 74 moves close to the conveyance path 14 as illustrated in FIG. 1, and makes contact with the upside face of the medium that is being conveyed in the conveyance path 14. When placed at the load position, the pick roller 74 performs rotation so that the singular medium, which is in contact with the pick roller 74, is conveyed toward the exit tray 51. When the pick roller 74 is in contact with the upside face of one of a plurality of singular mediums piled up, the rotation of the pick roller 74 may result in conveying of the singular mediums, which include the one singular medium making contact with the pick roller 74, toward the exit tray 51.

The separating roller 77 is formed to have a cylindrical shape. Similarly, the brake roller 78 is formed to have a cylindrical shape. The separating roller 77 and the brake roller 78 are disposed on the downstream side of the pick roller 74 in the conveyance path 14, that is, are disposed in between the pick roller 74 and the exit tray 51 in the conveyance path 14. Moreover, the separating roller 77 is disposed in the upper portion of the conveyance path 14 and makes contact with the upside face of the medium being conveyed in the conveyance path 14. The separating roller 77 performs rotation and conveys the medium, which is in contact with the separating roller 77, toward the exit tray 51. The brake roller 78 is disposed in the lower portion of the separating roller 77 in such a way that the separating roller 77 and the brake roller 78 make contact with each other or the medium that is conveyed in the conveyance path 14 gets sandwiched between the separating roller 77 and the brake roller 78.

The electromagnetic clutch 79 uses the electromagnetic force and either transmits or does not transmit the drive force to the brake roller 78. When the drive force is transmitted by the electromagnetic clutch 79, if the load exerted on the brake roller 78 is smaller than a predetermined value, the brake roller 78 performs negative rotation due to the drive force transmitted by the electromagnetic clutch 79. On the other hand, when the drive force is transmitted by the electromagnetic clutch 79, if the load exerted on the brake roller 78 is equal to or greater than the predetermined value, the transmission of the drive force is blocked due to a torque limiter and the brake roller 78 performs positive rotation following the rotation of the separating roller 77. Moreover, when the drive force is not transmitted by the electromagnetic clutch 79, the brake roller 78 performs positive rotation following the rotation of the separating roller 77.

Regarding a plurality of singular mediums sandwiched between the separating roller 77 and the brake roller 78, when the separating roller 77 is performing rotation and when the brake roller 78 performs negative rotation, the singular mediums that are not in contact with the separating roller 77 are prevented from being conveyed toward the downstream side and thus get separated. That is, as a result of switching between transmitting and not transmitting the drive force to the brake roller 78, the electromagnetic clutch 79 enables adjustment of the separating force meant for separating the singular mediums sandwiched between the separating roller 77 and the brake roller 78.

The medium detection sensor 76 is disposed in between the pick roller 74 and the separating roller 77 in the conveyance path 14. The medium detection sensor 76 detects whether or not the downstream-side leading end of the medium being conveyed in the conveyance path 14 has reached a predetermined position in between the pick roller 74 and the separating roller 77 in the conveyance path 14.

The first image reader 56 and the second image reader 57 are disposed on the downstream side of the second separator 55 in the conveyance path 14, that is, are disposed in between the second separator 55 and the exit tray 51 in the conveyance path 14. The first image reader 56 is disposed in the upper portion of the conveyance path 14 so as to be placed opposite to the upside face of the medium conveyed in the conveyance path 14. The second image reader 57 is disposed in the lower portion of the first image reader 56 so as to be placed opposite to the underside face of the medium conveyed in the conveyance path 14. The first image reader 56 takes an image of that face of the medium which faces the first image reader 56 while the medium is conveyed in the conveyance path 14. The second image reader 57 takes an image of that face of the medium which faces the second image reader 57 while the medium is conveyed in the conveyance path 14.

Figure 2:
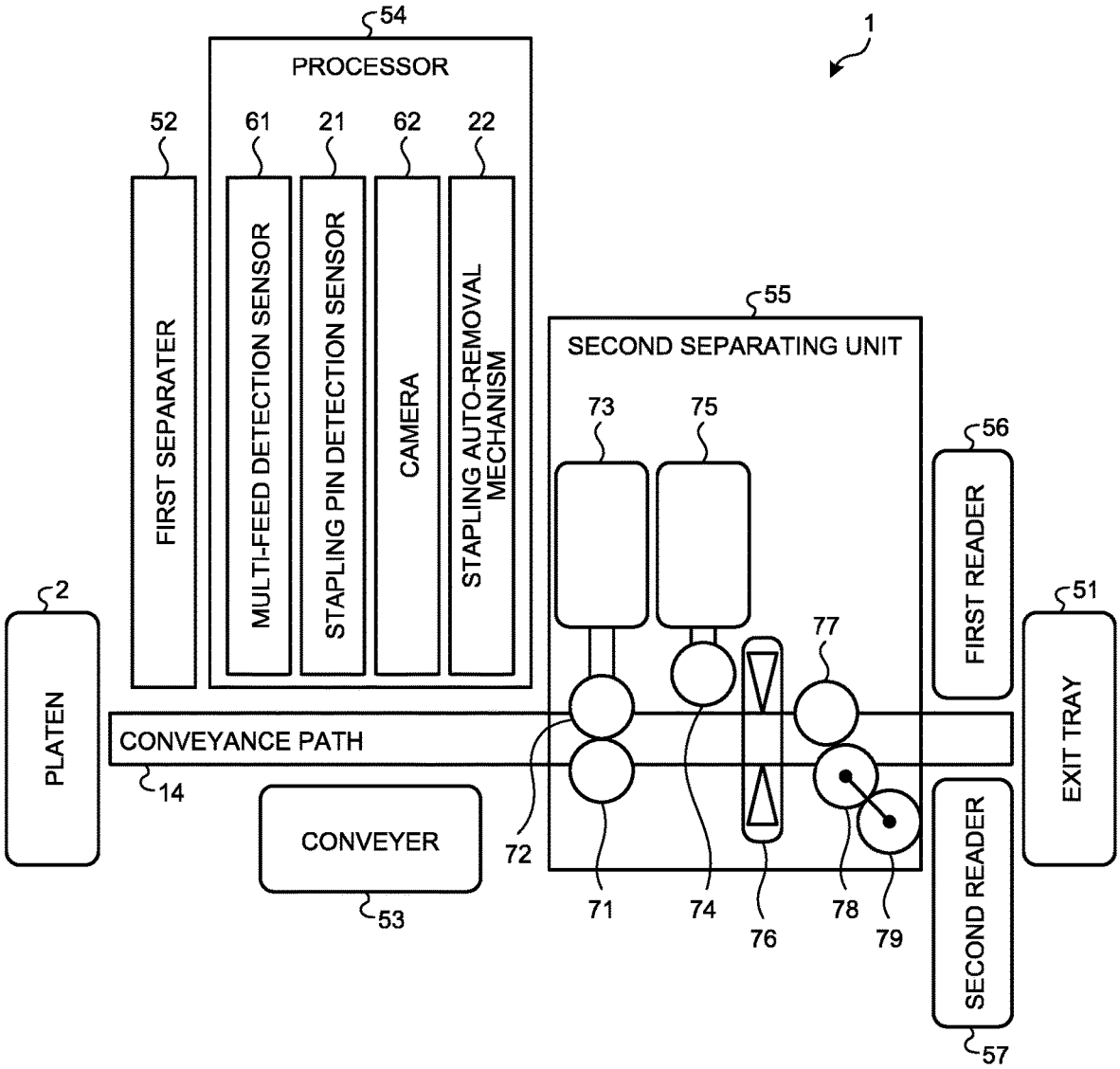
FIG. 2 is an outline side view of the medium conveyance device according to the first embodiment in the case in which a pinch roller is placed at a load position and a pick roller is placed at an away position.

FIG. 2 is an outline side view of the medium conveyance device 1 according to the first embodiment in the case in which the pinch roller 72 is placed at the load position and the pick roller 74 is placed at the away position. When placed at the load position, the pinch roller 72 makes contact with the conveyance roller 71 as illustrated in FIG. 2 or presses the medium being conveyed in the conveyance path 14 against the conveyance roller 71. When the pinch roller 72 is in contact with the conveyance roller 71 or when a medium is sandwiched between the conveyance roller 71 and the pinch roller 72, the pinch roller 72 performs rotation following the rotation of the conveyance roller 71. When the medium is pressed by the pinch roller 72 against the conveyance roller 71, the rotation of the conveyance roller 71 results in conveying of the medium, which is sandwiched between the conveyance roller 71 and the pinch roller 72, toward the exit tray 51.

When placed at the away position, the pick roller 74 retracts from the conveyance path 14 as illustrated in FIG. 2, and gets separated from the medium being conveyed in the conveyance path 14. Moreover, at the away position, since the pick roller 74 gets separated from the medium being conveyed in the conveyance path 14, even if the pick roller 74 performs rotation, the medium being conveyed in the conveyance path 14 is not conveyed forward.

Figure 3:
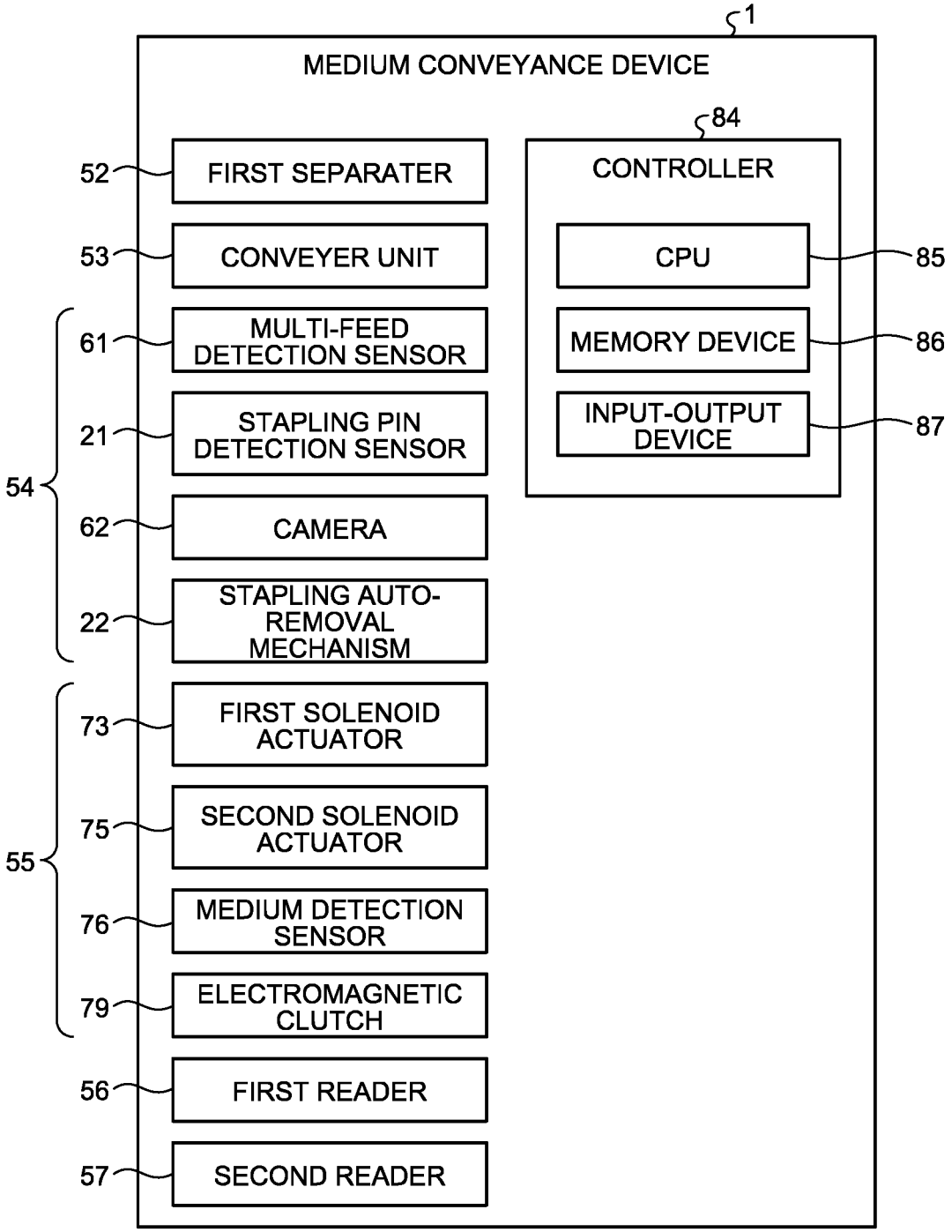
FIG. 3 is a block diagram of the medium conveyance device according to the first embodiment.

FIG. 3 is a block diagram of the medium conveyance device 1 according to the first embodiment. As illustrated in FIG. 3, the medium conveyance device 1 further includes a controller 84. Under the control of the controller 84, the first separator 52 sends a medium, which is placed on the platen 2, into the conveyance path 14. Moreover, under the control of the controller 84, the conveyer 53 conveys the medium, which has been sent into the conveyance path 14, along the conveyance path 14 and places it on the exit tray 51.

The controller 84 is a computer that includes a central processing unit (CPU) 85, a memory device 86, and an input-output device 87. The CPU 85 executes computer programs installed in the controller 84, and accordingly processes information and controls the memory device 86 and the input-output device 87. Moreover, the CPU 85 executes the computer programs and controls the first separator 52, the conveyer 53, the processor 54, the second separator 55, the first image reader 56, and the second image reader 57.

The memory device 86 is used to store the computer programs and the information to be used by the CPU 85. As the memory device 86, for example, it is possible to use a memory such as a random access memory (RAM) or a read only memory (ROM); a fixed disk drive such as a hard disk drive; a solid state drive (SSD); or an optical disk. The input-output device 87 is, for example, a touch-sensitive panel that outputs the information generated as a result of user operations to the CPU 85 and enables the user to recognize the information generated by the CPU 85.

Meanwhile, the CPU 85 can be configured using some other physical controller that is capable of comprehensively controlling the controller 84. Examples of the physical controller include a digital signal processor (DSP), a large scale integration (LSI) circuit, an application-specific integrated circuit (ASIC), and a field-programmable gate array (FPGA).

Figure 4:
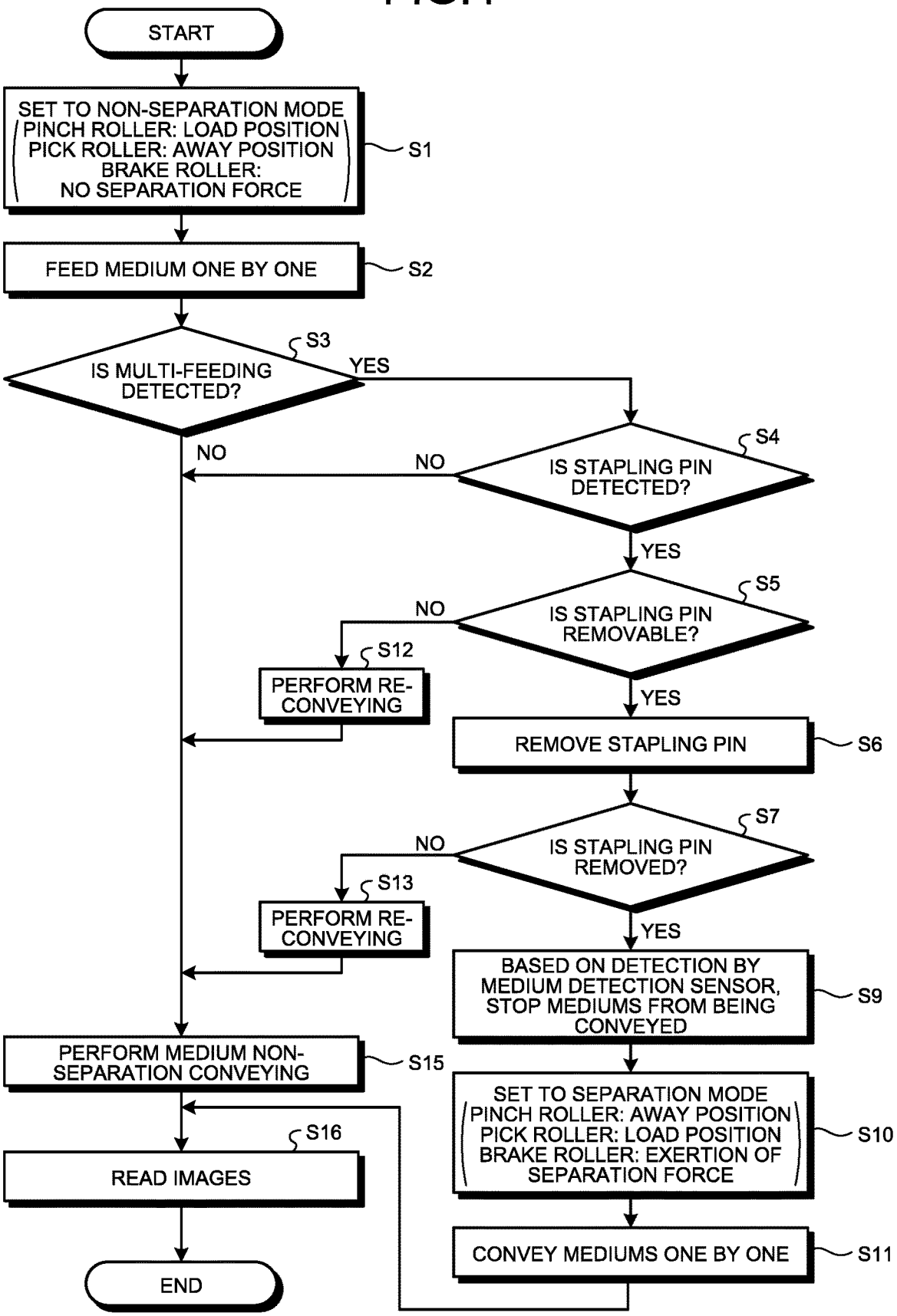
FIG. 4 is a flowchart for explaining the operations performed in the medium conveyance device according to the first embodiment.

FIG. 4 is a flowchart for explaining the operations performed in the medium conveyance device 1 according to the first embodiment. In order to read images from a plurality of mediums, the user places the mediums on the platen 2 and boots the medium conveyance device 1 by operating the input-output device 87. When the medium conveyance device 1 is booted, the controller 84 switches to a non-separation mode as illustrated in FIG. 4 (Step S1). That is, the controller 84 controls the first solenoid actuator 73 so as to move the pinch roller 72 to the load position. Moreover, the controller 84 controls the second solenoid actuator 75 so as to move the pick roller 74 to the away position. Furthermore, the controller 84 controls the electromagnetic clutch 79 so as to not transmit the drive force to the brake roller 78.

After switching to the non-separation mode, the controller 84 controls the first separator 52 so as to send one of the mediums, which are placed on the platen 2, into the conveyance path 14 (Step S2). After a medium has been sent into the conveyance path 14, the controller 84 controls the conveyer 53 so as to convey the medium, which has been sent into the conveyance path 14, along the conveyance path 14. Then, the controller 84 controls the multi-feed detection sensor 61 so as to detect whether or not the medium being conveyed in the conveyance path 14 is made of one singular medium (Step S3). If it is detected that a plurality of singular mediums is being conveyed in the conveyance path 14 (Yes at Step S3), then the controller 84 controls the stapling pin detection sensor 21 so as to detect whether or not the singular mediums are stapled (Step S4).

If it is detected that a stapled medium is being conveyed in the conveyance path 14 (Yes at Step S4), then the controller 84 controls the conveyer 53 so as to convey the stapled medium to the stapling auto-removal mechanism 22 and stop the staple medium from being conveyed further. While the stapled medium is stopped from being conveyed, the controller 84 controls the camera 62 so as to take an image of the stapled medium conveyed to the stapling auto-removal mechanism 22. Then, based on the image of the stapled medium as taken by the camera 62, the controller 84 determines whether or not the stapling can be removed from the stapled medium (Step S5).

If it is determined that stapling can be removed from the stapled medium (Yes at Step S5), then the controller 84 controls the stapling auto-removal mechanism 22 so as to remove the stapling from the stapled medium and obtain a plurality of singular mediums from the stapled medium (Step S6). However, even if the operation at Step S6 is performed, the stapling may be not properly removed from the stapled medium. Hence, after the stapling is removed from the stapled medium, the controller 84 controls the camera 62 so as to take an image of the topmost singular medium from among the singular mediums obtained by removing the stapling using the stapling auto-removal mechanism 22. Then, based on the image of the topmost singular medium as taken by the camera 62, the controller 84 detects whether or not the stapling has been properly removed from the stapled medium by the stapling auto-removal mechanism 22 (Step S7). If it is determined that the stapling has not been properly removed from the stapled medium (No at Step S7), then the controller 84 controls the conveyer 53 so as to resume conveying of the stapled medium and convey it to the second separator 55 (Step S13).

On the other hand, if it is determined that the stapling has been properly removed from the stapled medium (Yes at Step S7), then the controller 84 controls the conveyer 53 and the conveyance roller 71 so as to convey the singular mediums that are obtained by removing the stapling using the stapling auto-removal mechanism 22. When a plurality of singular mediums is being conveyed, the controller 84 controls the medium detection sensor 76 so as to detect whether or not the leading edges of the singular mediums have reached a predetermined position. If the leading edges of the singular mediums have reached a predetermined position, then the controller 84 controls the conveyer 53 and the conveyance roller 71 so as to stop the singular mediums from being conveyed further and from making contact with the separating roller 77, and to keep the singular mediums at the predetermined position (Step S9).

After the singular mediums are placed at the predetermined position, the controller 84 switches to a separation mode (Step S10). That is, the controller 84 controls the first solenoid actuator 73 so as to move the pinch roller 72 to the away position. Moreover, the controller 84 controls the second solenoid actuator 75 so as to move the pick roller 74 to the load position thereby establishing a contact between the pick roller 74 and the singular mediums placed at the predetermined position. Furthermore, the controller 84 controls the electromagnetic clutch 79 so as to transmit the drive force to the brake roller 78.

After switching to the separation mode, the controller 84 controls the second separator 55 so as to convey the singular mediums, which are placed at the predetermined position, one by one to the first image reader 56 and the second image reader 57 (Step S11). That is, after the singular mediums are placed at the predetermined position, the controller 84 rotates the pick roller 74 and the separating roller 77. When the separating roller 77 is in contact with the brake roller 78, the load that gets exerted from the separating roller 77 onto the brake roller 78 is greater than a predetermined value. Although the brake roller 78 receives the transmission of the drive force from the electromagnetic clutch 79, since the load exerted from the separating roller 77 is greater than the predetermined value, the transmission of the drive force is blocked due to the torque limiter and the brake roller 78 performs positive rotation following the rotation of the separating roller 77.

As a result of the rotation of the pick roller 74, the singular medium that, from among the singular mediums placed at the predetermined position, is in contact with the pick roller 74 is conveyed along the conveyance path 14 to the separating roller 77. After being conveyed to the separating roller 77, the singular medium gets sandwiched between the separating roller 77 and the brake roller 78. Then, as a result of the rotation of the separating roller 77, the singular medium that is sandwiched between the separating roller 77 and the brake roller 78 is conveyed to the first image reader 56 and the second image reader 57. At that time, due to the contact of the singular medium with the brake roller 78, the load exerted on the brake roller 78 from the separating roller 77 via that singular medium is greater than a predetermined value. Since the load exerted from the separating roller 77 is greater than the predetermined value, the transmission of the drive force is blocked due to the torque limiter and the brake roller 78 performs positive rotation following the rotation of the separating roller 77.

From among the singular mediums placed at the predetermined position, when the singular mediums not making contact with the pick roller 74 are in contact with the singular medium making contact with the pick roller 74, there are times when those singular mediums are conveyed to the separating roller 77 along with the singular medium making contact with the pick roller 74. The singular mediums that are conveyed to the separating roller 77 by the pick roller 74 get sandwiched between the separating roller 77 and the brake roller 78. From among the singular mediums that are sandwiched between the separating roller 77 and the brake roller 78, the singular medium that is making contact with the separating roller 77 is conveyed to the downstream side due to the rotation of the separating roller 77. At that time, the load exerted on the brake roller 78 from the separating roller 77 via the singular mediums becomes smaller than the predetermined value because of the sliding of the singular mediums against each other. Since the load exerted on the brake roller 78 from the separating roller 77 becomes smaller than the predetermined value, the brake roller 78 performs negative rotation due to the drive force transmitted from the electromagnetic clutch 79. As a result of the negative rotation of the brake roller 78, the singular medium that, from among the singular mediums sandwiched between the separating roller 77 and the brake roller 78, is making contact with the brake roller 78 gets separated from the singular medium making contact with the separating roller 77 and is thus prevented from being conveyed to the downstream side by the separating roller 77. From among the singular mediums sandwiched between the separating roller 77 and the brake roller 78, after the singular medium that was making contact with the separating roller 77 is conveyed to the downstream side, the singular medium that was not in contact with the separating roller 77 now makes contact with the separating roller 77. Then, due to the rotation of the separating roller 77, the singular medium making contact with the separating roller 77 gets separated from the other singular mediums and is conveyed to the downstream side.

Meanwhile, if it is determined that the stapling cannot be removed from the stapled medium (No at Step S5), then the controller 84 controls the conveyer 53 so as to resume conveying of the stapled medium and convey it to the second separator 55 (Step S12).

Moreover, if it is detected that only one singular medium is sent in the conveyance path 14 by the first separator 52 (No at Step S3), then the controller 84 controls the conveyer 53 so as to convey the singular medium to the second separator 55, and performs medium non-separation conveying (Step S15). Furthermore, if it is detected that the singular mediums are not stapled (No at Step S4), then the controller 84 controls the conveyer 53 so as to convey the singular mediums to the second separator 55, and performs medium non-separation conveying (Step S15). Moreover, after the operation at Step S12 is performed and after the operation at Step S13 is performed, the controller 84 performs medium non-separation conveying (Step S15).

In medium non-separation conveying, while maintaining the non-separation mode, the controller 84 rotates the conveyance roller 71 and the separating roller 77. The medium that is conveyed to the second separator 55 makes contact with the conveyance roller 71 and gets pressed against the conveyance roller 71 by the pinch roller 72. Then, due to the rotation of the conveyance roller 71, the medium that is pressed against the conveyance roller 71 by the pinch roller 72 is conveyed to the separating roller 77 along the conveyance path 14.

The medium that is conveyed to the separating roller 77 is sandwiched between the separating roller 77 and the brake roller 78. Due to the rotation of the separating roller 77, the singular medium that is making contact with the separating roller 77 is conveyed to the downstream side. Herein, a load gets exerted from the separating roller 77 on the brake roller 78 via the medium sandwiched between the separating roller 77 and the brake roller 78, and the brake roller 78 performs positive rotation due to absence of transmission of the drive force from the electromagnetic clutch 79. Even when the medium that is sandwiched between the separating roller 77 and the brake roller 78 is made of a plurality of singular mediums, because of the positive rotation of the brake roller 78, the singular mediums do not get separated from each other and are conveyed to the downstream side along with the singular medium making contact with the separating roller 77.

When a medium is conveyed to the first image reader 56 and the second image reader 57, the controller 84 controls the conveyer 53 so as to convey the medium, which has been conveyed to the first image reader 56 and the second image reader 57, at a constant speed. Moreover, the controller 84 controls the first image reader 56 so as to take an image that captures the upside face of the medium being conveyed at the constant speed. Furthermore, the controller 84 controls the second image reader 57 so as to take an image that captures the underside face of the medium being conveyed at the constant speed (Step S16). Moreover, the controller 84 controls the conveyer 53 so as to further convey the medium from which images have been read by the first image reader 56 and the second image reader 57; and to place the medium, from which images have been read, on the exit tray 51. The controller 84 performs the operations from Step S1 to Step S16 until all of the mediums placed on the platen 2 have been sent into the conveyance path 14 by the first separator 52.

Effects of Medium Conveyance Device 1 According to First Embodiment

The medium conveyance device 1 according to the first embodiment includes the first separator 52, the processor 54, the second separator 55, and the controller 84. The first separator 52 separates a first medium from a plurality of mediums. The processor 54 processes the first medium and obtains a second medium. Based on the information obtained by processing the first medium, the controller 84 switches between the non-separation mode and the separation mode. In the non-separation mode, the second separator 55 conveys the second medium to the first image reader 56 and the second image reader 57. In the separation mode, the second separator 55 conveys a third medium, which is separated from the second medium, to the first image reader 56 and the second image reader 57.

In the medium conveyance device 1, based on the information obtained as a result of the operation for obtaining a second medium from a first medium, it becomes possible to properly determine whether or not the second medium is separable using the second separator 55. In the medium conveyance device 1, if the second medium is not separable, the second separator 55 does not separate the second medium so as to prevent damage to the second medium or prevent paper jam attributed to separation of the second medium. On the other hand, in the medium conveyance device 1, if the second medium is separable, the second separator 55 separates the second medium so as to prevent multi-feeding of a plurality of mediums to the first image reader 56 and the second image reader 57.

Moreover, in the medium conveyance device 1 according to the first embodiment, the processor 54 includes the multi-feed detection sensor 61 that detects whether a first medium is made of a plurality of singular mediums or made of one singular medium. If it is detected that a first medium is made of one singular medium, then the controller 84 switches to the non-separation mode.

In the medium conveyance device 1, as a result of switching between the non-separation mode and the separation mode based on whether or not there is multi-feeding of the first medium, the singular mediums are prevented from being separated by the second separator 55. For example, in the medium conveyance device 1, since the singular mediums are not separated by the second separator 55, it becomes possible to convey the singular mediums to the first image reader 56 and the second image reader 57 at a fast rate.

Meanwhile, in the medium conveyance device 1 according to the first embodiment, although the multi-feed detection sensor 61 is installed, it can alternatively be omitted. In the medium conveyance device 1, if the multi-feed detection sensor 61 is omitted, the operation performed at Step S2 is followed by the operation performed at Step S4. In that case too, in the medium conveyance device 1, as a result of removing the stapling from the singular mediums detected to have been stapled, the singular mediums can be separated using the second separator 55 and can be conveyed one by one to the first image reader 56 and the second image reader 57.

Moreover, in the medium conveyance device 1 according to the first embodiment, the processor 54 further includes the stapling auto-removal mechanism 22 for removing the stapling from a first medium. If the stapling is not detected, then the controller 84 controls the stapling auto-removal mechanism 22 to not remove the stapling from the first medium. On the other hand, if the stapling is detected, then the controller 84 controls the stapling auto-removal mechanism 22 to remove the stapling from the first medium, and switches to the separation mode.

In the medium conveyance device 1, as a result of removing the stapling from a bound medium detected to have been stapled, the stapled singular mediums can be conveyed one by one to the first image reader 56 and the second image reader 57. Moreover, in the medium conveyance device 1, when the stapling is not detected, stapling removal is not performed with respect to the medium thereby enabling achieving shortening of the time taken by the medium to pass through the processor 54. That is, in the medium conveyance device 1, it becomes possible to shorten the time taken by the medium to reach the second separator 55 after being sent out from the first separator 52, and to shorten the time taken by the medium to reach the first image reader 56 and the second image reader 57 after being sent out from the first separator 52.

Furthermore, in the medium conveyance device 1 according to the first embodiment, if the stapling is not detected; then the controller 84 switches to the non-separation mode. In the medium conveyance device 1, when a first medium is a bound medium but when the stapling pin detection sensor 21 cannot detect the stapling, the bound medium is not separated using the second separator 55, thereby enabling prevention of damage to the bound medium and prevention of paper jam.

Moreover, in the medium conveyance device 1 according to the first embodiment, the controller 84 controls the camera 62 so as to enable detection of whether or not the stapling is removed from a first medium, and switches between the non-separation mode and the separation mode based on whether or not the stapling is removed from the first medium. Thus, in the medium conveyance device 1, a bound medium from which the stapling could not be properly removed can be prevented from getting separated into singular mediums, thereby enabling prevention of damage to the bound medium from which the stapling has not been properly removed.

Furthermore, in the medium conveyance device 1 according to the first embodiment, the second separator 55 includes the separating roller 77, the brake roller 78, and the electromagnetic clutch 79. The separating roller 77 comes in contact with a third medium and conveys it forward. When the separating roller 77 is conveying a third medium, the brake roller 78 comes in contact with a fourth medium that is part of the second medium but different than the third medium. The electromagnetic clutch 79 switches between transmitting and not transmitting the drive force to the brake roller 78 so as to adjust the separation force by which the brake roller 78 separates the third medium and the fourth medium from each other. In the separation mode, the controller 84 controls the electromagnetic clutch 79 in such a way that the separation force becomes greater than a predetermined amount of force. In the non-separation mode, the controller 84 controls the electromagnetic clutch 79 in such a way that the separation force becomes smaller than the predetermined amount of force.

The separating roller 77 and the brake roller 78 separate a plurality of mediums using friction. Hence, the mediums can be separated by a relatively stronger separation force, and multi-feeding is less likely to occur. Thus, in the medium conveyance device 1, since the separating roller 77 and the brake roller 78 separate a plurality of mediums using friction, a third medium and a fourth medium can be separated from each other by a relatively stronger separation force, and multi-feeding is less likely to occur.

Herein, by switching between transmitting and not transmitting the drive force to the brake roller 78, the electromagnetic clutch 79 adjusts the separation force for separating a plurality of singular mediums. Alternatively, the separation force for separating a plurality of singular mediums can be adjusted using some other method, and some other type of brake can be used to separate the singular mediums. For example, in the separation mode, that brake applies braking to the rotation of the separating roller 77; and, in the non-separation mode, the brake releases the braking of the rotation of separating roller 77. Even if such a brake is installed, when the separation mode is set and when a plurality of singular mediums is conveyed to the separating roller 77, the second separator 55 can separate, from the singular mediums, one singular medium that, from among the singular mediums, is making contact with the separating roller 77. Moreover, even if such a brake is installed, when the non-separation mode is set and when a plurality of singular mediums is conveyed to the separating roller 77, the second separator 55 can convey the singular mediums, which have been conveyed to the separation roller 77, without separating them.

In the medium conveyance device according to the first embodiment, the second separator 55 further includes the conveyance roller 71, the pick roller 74, the second solenoid actuator 75, and the medium detection sensor 76. The conveyance roller 71 performs rotation and conveys a second medium. The pick roller 74 comes in contact with a third medium and conveys it. The second solenoid actuator 75 moves the pick roller 74. The medium detection sensor 76 detects whether or not the second medium has reached a predetermined position. When the non-separation mode is set, the controller 84 controls the second solenoid actuator 75 in such a way that the pick roller 74 does not make contact with the third medium, and controls the conveyance roller 71 in such a way that the second medium is conveyed from the processor 54 to the separating roller 77. If the third medium reaches the predetermined position before the separation mode is set, then the controller 84 controls the conveyance roller 71 in such a way that the second medium is stopped from being conveyed further. When the separation mode is set, the controller 84 controls the second solenoid actuator 75 in such a way that the pick roller 74 comes in contact with the third medium.

Thus, in the medium conveyance device 1, when the non-separation mode is set, the pick roller 74 moves away from the third medium so that the second medium can be conveyed to the separating roller 77 and the brake roller 78 without being affected by the pick roller 74. Moreover, in the medium conveyance device 1, when the non-separation mode is set, the pick roller 74 moves away from the third medium so that the second medium can be properly conveyed by the conveyance roller 71, the separating roller 77, and the brake roller 78. On the other hand, in the medium conveyance device 1, when the separation mode is set, the second medium is stopped at a predetermined position, so that the third medium can be properly conveyed to the separating roller 77 by the pick roller 74. Thus, in the medium conveyance device 1, since the third medium is properly conveyed to the separating roller 77, the third medium and the fourth medium can be properly separated using the separating roller 77 and the brake roller 78.

Moreover, in the medium conveyance device 1, the second separator 55 further includes the pinch roller 72 and the first solenoid actuator 73. The pinch roller 72 presses a second medium against the conveyance roller 71. The first solenoid actuator 73 adjusts the gap between the conveyance roller 71 and the pinch roller 72. When the non-separation mode is set, the controller 84 controls the first solenoid actuator 73 in such a way that the second medium is pressed against the conveyance roller 71 by the pinch roller 72. After the second medium reaches a predetermined position, the controller 84 switches to the separation mode and then controls the first solenoid actuator 73 in such a way that the second medium is not pressed against the conveyance roller 71 by the pinch roller 72.

Thus, in the medium conveyance device 1, when the separation mode is set, the conveyance roller 71 and the pinch roller 72 move away from each other so that the pick roller 74 can properly convey a third medium to the separating roller 77. In the medium conveyance device 1, since the third medium is properly conveyed to the separating roller 77, the separating roller 77 and the brake roller 78 can convey the third medium toward the downward side after properly separating it from the fourth medium.

Furthermore, the medium conveyance device 1 according to the first embodiment further includes the first image reader 56 and the second image reader 57. When the second separator 55 conveys a second medium to the first image reader 56 and the second image reader 57, the first image reader 56 and the second image reader 57 read images of the second medium. When the second separator 55 conveys a third medium to the first image reader 56 and the second image reader 57, the first image reader 56 and the second image reader 57 read images of the third medium. Thus, in a scanner in which the medium conveyance device 1 is installed, as a result of properly separating a plurality of mediums, the images of each medium can be properly taken.

Second Embodiment

Figure 5:
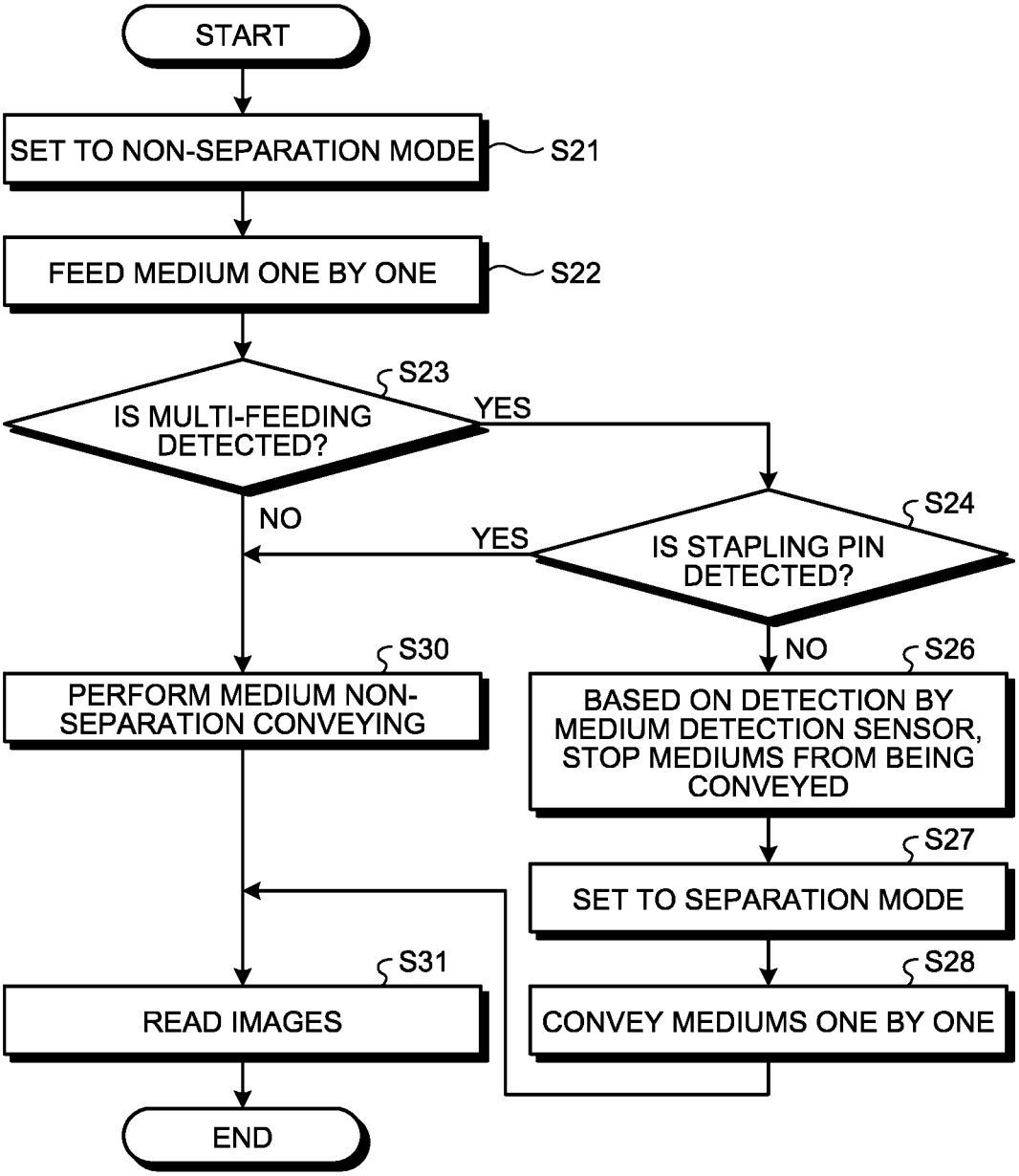
FIG. 5 is a flowchart for explaining the operations performed in a medium conveyance device according to a second embodiment.

FIG. 5 is a flowchart for explaining the operations performed in a medium conveyance device according to a second embodiment. The medium conveyance device according to the second embodiment is configured by omitting the camera 62 and the stapling auto-removal mechanism 22 from the medium conveyance device 1 according to the first embodiment. When the user wishes to read images from a plurality of mediums, he or she places the mediums on the platen 2 and boots the medium conveyance device by operating the input-output device 87. When the medium conveyance device is booted, the controller 84 switches to the non-separation mode as illustrated in FIG. 5 in an identical to Step S1 (Step S21).

After switching to the non-separation mode, the controller 84 controls the first separator 52 so as to send one of the mediums, which are placed on the platen 2, into the conveyance path 14 (Step S22). After a medium has been sent into the conveyance path 14, the controller 84 controls the conveyer 53 and conveys the medium, which has been sent into the conveyance path 14, along the conveyance path 14. Then, the controller 84 controls the multi-feed detection sensor 61 so as to detect whether the medium conveyed in the conveyance path 14 is made of a plurality of singular mediums or made of only one singular medium (Step S23). If it is detected that a plurality of singular mediums is being conveyed in the conveyance path 14 (Yes at Step S23), then the controller 84 controls the stapling pin detection sensor 21 so as to detect whether or not the singular mediums are stapled (Step S24).

If it is detected that the singular mediums are not stapled (No at Step S24), then the controller 84 controls the medium detection sensor 76 so as to detect whether or not the leading ends of the singular mediums have reached a predetermined position. If it is detected that the leading ends of the singular mediums have reached a predetermined position, then the controller 84 controls the conveyer 53 and the conveyance roller 71 so as to stop the singular mediums from being conveyed further and to place the singular mediums at a predetermined position (Step S26). After the singular mediums are placed at the predetermined position, the controller 84 switches to the separation mode in an identical manner to Step S10 (Step S27).

After switching to the separation mode, in an identical manner to Step S11, the controller 84 controls the second separator 55 so as to convey the singular mediums, which are placed at the predetermined position, one by one to the first image reader 56 and the second image reader 57 (Step S28).

Meanwhile, if it is detected that only one singular medium is sent into the conveyance path 14 by the first separator 52 (No at Step S23); then, in an identical manner to Step S15, the controller 84 controls the conveyer 53 so as to convey the singular medium to the second separator 55, and performs medium non-separation conveying (Step S30). Moreover, if it is detected that the singular mediums are stapled (Yes at Step S24), then the controller 84 controls the conveyer 53 so as to convey the singular mediums to the second separator 55, and performs medium non-separation conveying (Step S30).

When a medium is conveyed to the first image reader 56 and the second image reader 57; in an identical manner to Step S16, the controller 84 controls the conveyer 53, the first image reader 56, and the second image reader 57 so as to take two images that capture both faces of the medium conveyed to the first image reader 56 and the second image reader 57 (Step S31). Moreover, the controller 84 controls the conveyer 53 so as to further convey the medium from which images have been read by the first image reader 56 and the second image reader 57; and to place the medium, from which images have been read, on the exit tray 51. The controller 84 performs the operations from Step S21 to Step S31 until all of the mediums placed on the platen 2 have been sent into the conveyance path 14 by the first separator 52.

Effects of Medium Conveyance Device According to Second Embodiment

In the medium conveyance device according to the second embodiment, the processor 54 includes the stapling pin detection sensor 21 that detects the presence or absence of stapling of a first medium that has been separated from a plurality of mediums by the first separator 52. Based on the presence of absence of stapling, the controller 84 switches between the non-separation mode and the separation mode.

For example, in the medium conveyance device, the separation mode can be set when a plurality of singular mediums is not bound together, and the singular mediums can be conveyed one by one to the first image reader 56 and the second image reader 57. On the other hand, in the medium conveyance device, the non-separation mode can be set when a plurality of singular mediums is bound together, and the bound medium can be prevented from getting separated by the second separator 55 thereby enabling prevention of damage to the bound medium or prevention of paper jam.

Third Embodiment

Figure 6:
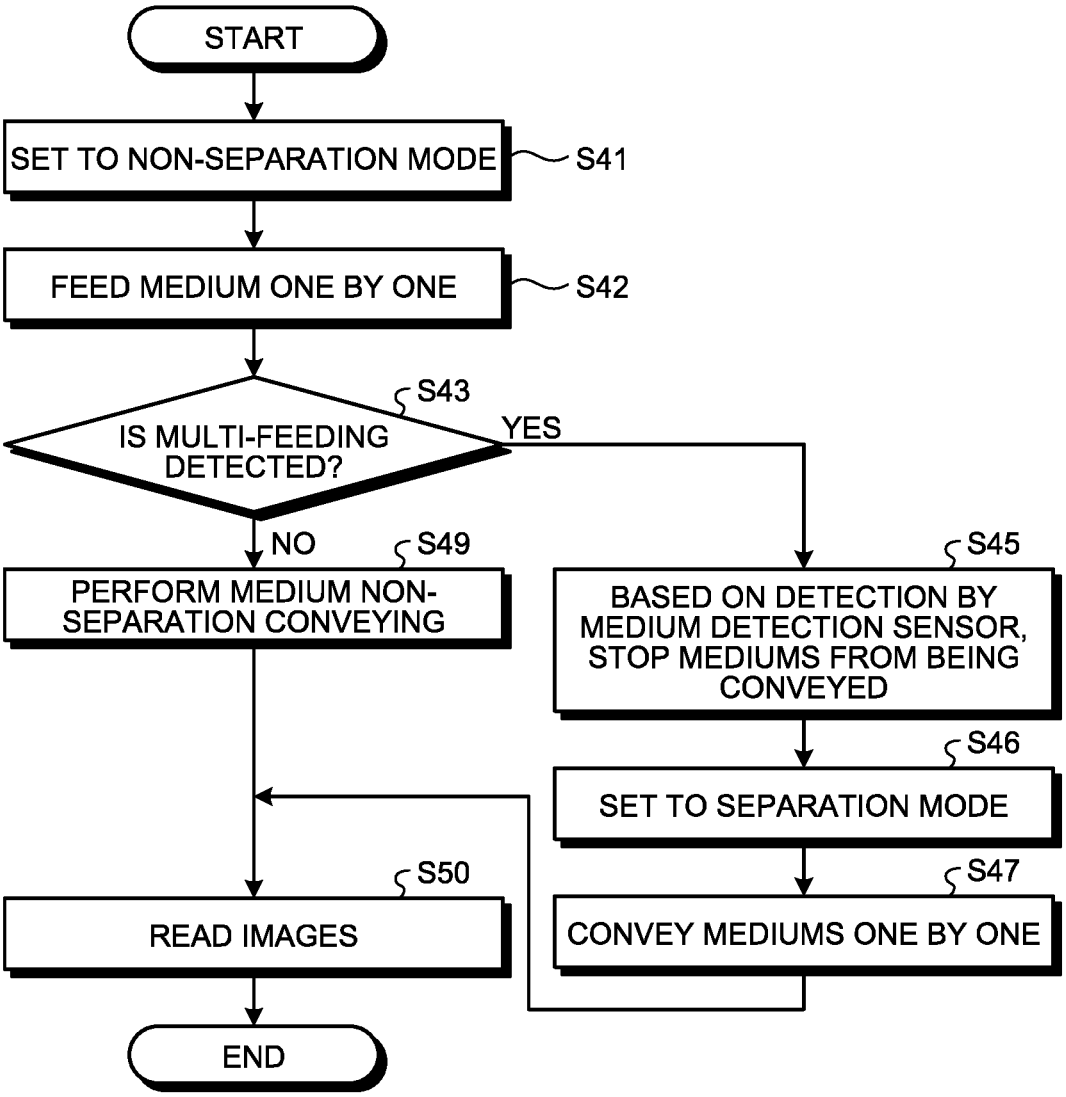
FIG. 6 is a flowchart for explaining the operations performed in a medium conveyance device according to a third embodiment.

FIG. 6 is a flowchart for explaining the operations performed in a medium conveyance device according to a third embodiment. The medium conveyance device according to the third embodiment is configured by omitting the stapling pin detection sensor 21, the camera 62, and the stapling auto-removal mechanism 22 from the medium conveyance device 1 according to the first embodiment. When the user wishes to read images from a plurality of mediums, he or she places the mediums on the platen 2 and boots the medium conveyance device by operating the input-output device 87. When the medium conveyance device is booted, the controller 84 switches to the non-separation mode as illustrated in FIG. 6 in an identical to Step S1 (Step S41).

After switching to the non-separation mode, the controller 84 controls the first separator 52 so as to send one of the mediums, which are placed on the platen 2, into the conveyance path 14 (Step S42). After a medium has been sent into the conveyance path 14, the controller 84 controls the conveyer 53 and conveys the medium, which has been sent into the conveyance path 14, along the conveyance path 14. Then, the controller 84 controls the multi-feed detection sensor 61 so as to detect whether the medium conveyed in the conveyance path 14 is made of a plurality of singular mediums or made of only one singular medium (Step S43).

If it is detected that a plurality of singular mediums is being conveyed (Yes at Step S43), then the controller 84 controls the medium detection sensor 76 so as to detect whether or not the leading ends of the singular mediums have reached a predetermined position. If it is detected that the leading ends of the singular mediums have reached a predetermined position, then the controller 84 controls the conveyer 53 and the conveyance roller 71 so as to stop the singular mediums from being conveyed further and to place the singular mediums at a predetermined position (Step S45).

After the singular mediums are placed at the predetermined position, the controller 84 switches to the separation mode in an identical manner to Step S10 (Step S46). After switching to the separation mode, in an identical manner to Step S11, the controller 84 controls the second separator 55 so as to convey the singular mediums, which are placed at the predetermined position, one by one to the first image reader 56 and the second image reader 57 (Step S47).

Meanwhile, if it is detected that only one singular medium is sent into the conveyance path 14 by the first separator 52 (No at Step S43); then, in an identical manner to Step S15, the controller 84 controls the conveyer 53 so as to convey the singular medium to the second separator 55, and performs medium non-separation conveying (Step S49).

When a medium is conveyed to the first image reader 56 and the second image reader 57; in an identical manner to Step S16, the controller 84 controls the conveyer 53, the first image reader 56, and the second image reader 57 so as to take two images that capture both faces of the medium conveyed to the first image reader 56 and the second image reader 57 (Step S50). Moreover, the controller 84 controls the conveyer 53 so as to further convey the medium from which images have been read by the first image reader 56 and the second image reader 57; and to place the medium, from which images have been read, on the exit tray 51.

The controller 84 performs the operations from Step S41 to Step S50 until all of the mediums placed on the platen 2 have been sent into the conveyance path 14 by the first separator 52.

As a result of performing such operations, in the medium conveyance device according to the third embodiment, even if a plurality of singular mediums is sent out into the conveyance path 14 by the first separator 52, the singular mediums can be separated using the second separator 55 and can be properly conveyed one by one to the first image reader 56 and the second image reader 57.

Moreover, in the medium conveyance device 1, the first separator 52 separates a first medium from a plurality of mediums using the airflow. In air paper-feeding in which a plurality of mediums is separated using the airflow, although a bound medium can be sent out in a proper manner, the separation capacity is relatively weaker and multi-feeding is more likely to occur. In the medium conveyance device 1, even when the first separator 52 enables air paper-feeding, since multi-feeding in the first separator 52 is handled by separating the mediums using the second separator 55, it becomes possible to properly convey a plurality of mediums to the first image reader 56 and the second image reader 57.

Meanwhile, in the medium conveyance devices according to the embodiments described above, although the first separator 52 separates a single medium from a plurality of mediums using the airflow, it is alternatively possible to separate a single medium from a plurality of mediums using some other physical phenomenon other than the airflow. For example, the first separator 52 can be substituted with another first separator that, in an identical manner to the second separator 55, separates a single medium from a plurality of mediums using the frictional force. In that case too, the separation force exerted by the substituted first separator for separating a plurality of mediums is smaller than the separation force exerted by the second separator 55 for separating a plurality of mediums in the separation mode. Hence, the substituted first separator can separate a plurality of mediums without separating a bound medium any further, and is more prone to multi-feeding as compared to the second separator 55. In the medium conveyance device, even when such a first separator is substituted, a plurality of mediums can be properly separated in an identical manner to the medium conveyance device according to the embodiments described above.

Meanwhile, although the medium conveyance device according to the embodiments described above includes the first image reader 56 and the second image reader 57, it is possible to omit one of the first image reader 56 and the second image reader 57. In the medium conveyance device, even if one of the first image reader 56 and the second image reader 57 is omitted, a plurality of mediums placed on the platen 2 can be properly separated and images of one face of the separated mediums can be read. Moreover, although the medium conveyance device according to the embodiments described above includes the first image reader 56 and the second image reader 57, it is possible to substitute the first image reader 56 and the second image reader 57 with a next processor. Examples of the next processor include a printer that, under the control of the controller 84, prints a predetermined image on a medium that is conveyed from the second separator 55. Even if such a printer is installed in the medium conveyance device, a plurality of mediums can be properly separated in an identical manner to the medium conveyance device according to the embodiments described above. When such a printer is installed in the medium conveyance device, it becomes possible to print predetermined images on a plurality of singular mediums that is obtained as a result of removing the stapling from a bound medium formed as a result of binding backing sheets have one unused face. Meanwhile, although the medium conveyance device according to the embodiments described above includes the first image reader 56 and the second image reader 57, it is possible to omit the first image reader 56 as well as the second image reader 57. If the first image reader 56 as well as the second image reader 57 is omitted from the medium conveyance device, then the medium conveyance device can be used as a paper feeding device for feeding the separated mediums one by one to an external device.

In the medium conveyance device according to the embodiments described above, whether or not the stapling can be removed is detected based on the image of the medium as taken by the camera 62. Alternatively, whether or not the stapling can be removed can be detected using some other binding-member state sensor. Examples of the binding-member state sensor include a face pressure sensor. In the face pressure sensor, a contact face is formed and, when the contact face comes in contact with a medium, the distribution of the pressure exerted on the contact face is detected. Based on the distribution of the pressure detected as a result of bringing the contact face of the face pressure sensor to be in contact with a medium, the controller 84 can detect the state (the shape and the orientation) of the stapling of the mediums and, based on that state, can detect whether or not the stapling can be removed from the medium. In the medium conveyance device, when the camera 62 is substituted with such a binding-member state sensor, a plurality of mediums can be properly separated in an identical manner to the medium conveyance device according to the embodiments described above.

The medium conveyance device disclosed in the application concerned can properly separate a plurality of mediums.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveyance device comprising:

a first separator configured to separate a first medium from a plurality of mediums;

a processor configured to process the first medium and send the processed first medium as a second medium;

a second separator configured to convey the second medium to a next processor when a non-separation mode is set and to convey a third medium, which is separated from the second medium, to the next processor when a separation mode is set; and a controller configured to switch between the non-separation mode and the separation mode based on information obtained as a result of processing the first medium.

2. The medium conveyance device according to claim 1, wherein the processor includes a multi-feed sensor that detects whether the first medium is made of a plurality of singular mediums or made of one singular medium, and when the multi-feed sensor detects that the first medium is made of one singular medium, the controller switches to the non-separation mode.

3. The medium conveyance device according to claim 1, wherein the processor includes a binding member detection sensor that detects presence or absence of a binding member used for binding the first medium, and the controller switches between the non-separation mode and the separation mode based on presence or absence of the binding member.

4. The medium conveyance device according to claim 1, wherein the first separator separates the first medium from the mediums using airflow.

5. The medium conveyance device according to claim 1, wherein the second separator includes a separating roller that makes contact with the third medium and conveys the third medium, a brake roller that, when the third medium is conveyed by the separating roller, makes contact with a fourth medium which is part of the second medium but which is different than the third medium, and a clutch that adjusts separation force exerted by the brake roller for separating the third medium and the fourth medium, when the separation mode is set, the controller controls the clutch to keep the separation force to be greater than a predetermined amount of force, and when the non-separation mode is set, the controller controls the clutch to keep the separation force to be smaller than the predetermined amount of force.

6. The medium conveyance device according to claim 5, wherein the second separator includes a conveyance roller that conveys the second medium, a pick roller that makes contact with the third medium and conveys the third medium, a driver that moves the pick roller, and a medium detection sensor that detects arrival of the second medium at a predetermined position, when the non-separation mode is set, the controller controls the driver in such a way that the pick roller does not make contact with the third medium, and controls the conveyance roller in such a way that the second medium is conveyed from the processor to the separating roller, before the separation mode is set, when the third medium reaches the predetermined position, the controller controls the conveyance roller in such a way that the second medium is stopped from being conveyed further, and when the separation mode is set, the controller controls the driver in such a way that the pick roller makes contact with the third medium.

7. The medium conveyance device according to claim 6, wherein the second separator includes a pinch roller that presses the second medium against the conveyance roller, and an adjuster configured to adjust gap between the pinch roller and the conveyance roller, and the controller controls the adjuster in such a way that, when the non-separation mode is set, the second medium is pressed against the conveyance roller by the pinch roller, switches to the separation mode after the second medium has reached the predetermined position, and controls the adjuster in such a way that, when the separation mode is set, the second medium is not pressed against the conveyance roller by the pinch roller.

8. The medium conveyance device according to claim 1, further comprising the next processor, wherein when the second separator conveys the second medium to the next processor, the next processor reads an image of the second medium, and when the second separator conveys the third medium to the next processor, the next processor reads an image of the third medium.

* * * * *